United States Patent [19]

Deal et al.

[11] Patent Number: 5,023,509

[45] Date of Patent: Jun. 11, 1991

[54] COLOR CRT-YOKE COMBINATION HAVING CONFORMING CORRECTIVE MAGNETIC FIELD MEANS ATTACHED TO THE CRT

[75] Inventors: Samuel B. Deal, Lancaster, Pa.; James A. Calamari, Jr., Marion, Ind.

[73] Assignee: RCA Licensing Corp., Princeton, N.J.

[21] Appl. No.: 427,403

[22] Filed: Oct. 27, 1989

[51] Int. Cl.[5] ..... H01J 29/70

[52] U.S. Cl. ..... 313/430; 313/431; 313/412; 335/217

[58] Field of Search ..... 313/412, 430, 431, 437, 313/477 R, 440; 358/248, 249; 335/211, 212, 217

[56] References Cited

U.S. PATENT DOCUMENTS

| | | | |
|---|---|---|---|
| 2,459,732 | 1/1949 | Bradley | 313/430 |
| 3,873,877 | 3/1975 | Machida et al. | 313/430 |
| 3,899,710 | 8/1975 | Machida et al. | 313/412 |

*Primary Examiner*—Kenneth Wieder
*Assistant Examiner*—Diab Hamadi
*Attorney, Agent, or Firm*—James S. Tripoli; Dennis H. Irlbeck; Vincent J. Coughlin, Jr.

[57] ABSTRACT

A color cathode-ray tube-yoke combination comprises a color cathode-ray tube having a glass envelope and a yoke for producing magnetic fields positioned thereon. At least one semi-flexible corrective magnet is attached to a curved portion of the envelope. The novel corrective magnet is improved over prior corrective magnets by the inclusion therein of at least one portion of reduced thickness which increases the flexibility of the corrective magnet to provide conformity to the curved surface portion of the envelope.

13 Claims, 3 Drawing Sheets

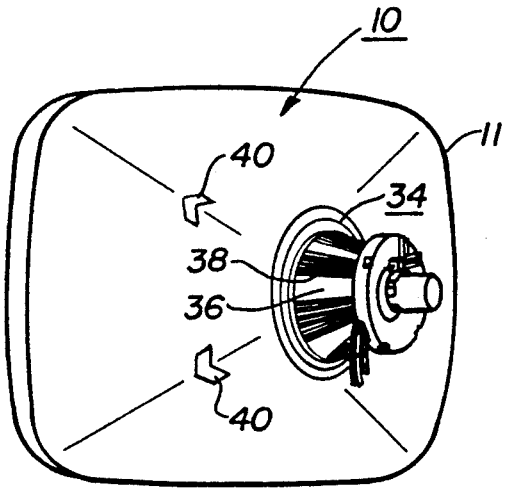
Fig. 2
PRIOR ART
Fig. 3
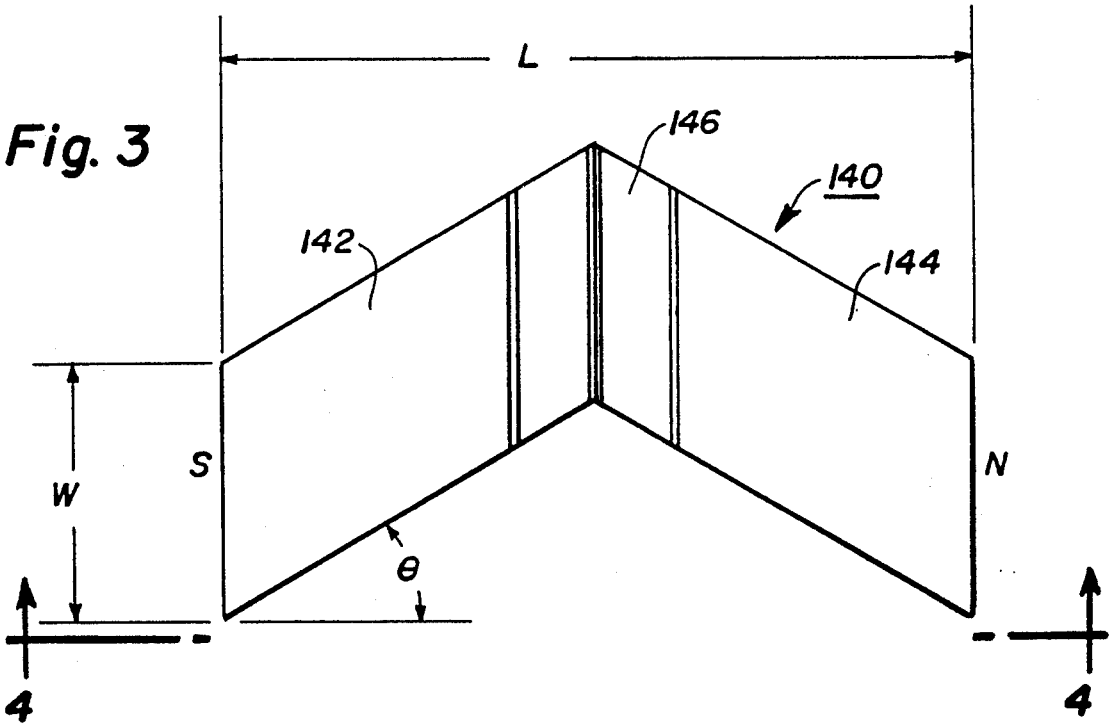
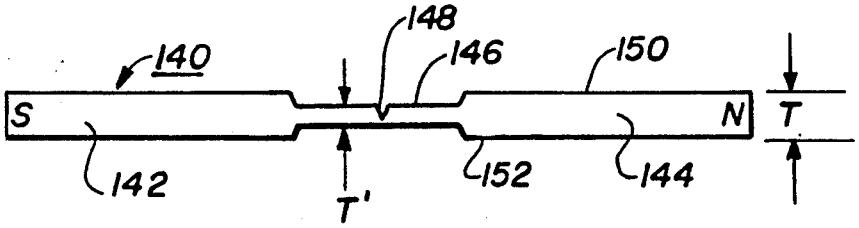
Fig. 4

N
S
L
W
T
T'
240
242
244
246
248
250
252
254
256
340
342
344
346
348
6
8

COLOR CRT-YOKE COMBINATION HAVING CONFORMING CORRECTIVE MAGNETIC FIELD MEANS ATTACHED TO THE CRT

This invention relates to a color cathode-ray tube (CRT)-yoke combination, and particularly to a CRT-yoke combination having a corrective magnetic field means of increased flexibility attached to a curved portion of the CRT to compensate for any non-uniformities in the magnetic field of the yoke.

BACKGROUND OF THE INVENTION

U.S. Pat. No. 3,899,710 issued to Machida et al. on Aug. 12, 1975 describes a color CRT with temperature-responsive color purity magnets attached to the CRT envelope to compensate for beam mislanding on the color phosphor screen caused by thermal expansion of the shadow mask during tube operation. Other expedients such as temperature compensation of the shadow mask, and improved mask material and coating have eliminated the need for such external color purity magnets. However, external magnets are still used to provide corrective or "trimmer" magnetic fields to compensate for non-uniformities in the magnetic field of the deflection yoke positioned on the envelope of the CRT. The need for such "trimmer" magnets is most frequent when tube manufacturers provide CRT-yoke combinations to other original equipment manufacturers (OEM) for use in television receivers or display devices. The OEM may specify a yoke compatible with the receiver which, however, is not optimized for use with the tube on which it is positioned. In such a case, one or more "trimmer" magnets are attached to the outside surface of the tube envelope to compensate for any non-uniformities in the yoke, thereby providing proper register between the electron beams and the color phosphor screen. One type of "trimmer" magnet comprises an extruded strip of plastic filled with ferrite material. Such a trimmer magnet is sold under the name ULTRAMAG 500 and is available from Magnets, Inc. Cincinnati, Oh. The magnet is semi-flexible, meaning that it can be formed to the curved exterior surface of the tube envelope under normal temperature conditions; however, at low temperatures the material is difficult to shape and tends to straighten. The usual method of attaching the magnet to the tube envelope is to apply an adhesive to one side of the magnet; however, the ends of the magnet tend to lift away from the tube envelope during cold weather shipping and storage of the CRT-yoke combination. When this occurs, the free ends of the magnet may be caught on other surfaces during unpacking, handling, or assembly into a receiver or display device, and the "trimmer" magnet may be dislodged or damaged so that the CRT-yoke combination does not operate satisfactorily. The need thus exists for a means of assuring that the "trimmer" magnet remains attached to the CRT-yoke combination.

SUMMARY OF THE INVENTION

A color cathode-ray tube-yoke combination comprises a color cathode-ray tube having a glass envelope and means for producing magnetic fields positioned on the envelope. At least one semi-flexible, corrective magnetic field means is attached to a curved portion of the envelope. The corrective magnetic field means is improved over prior structures by the inclusion therein of at least one portion of reduced thickness which increases the flexibility of the corrective magnetic field means to provide conformity to the curved portion of the envelope.

BRIEF DESCRIPTION OF THE DRAWINGS

FIG. 2 is a perspective view of the CRT-yoke combination of FIG. 1.

FIGS. 3 and 4 show a plan view and a side respectively, of one embodiment of the present invention.

DETAILED DESCRIPTION OF THE PREFERRED EMBODIMENTS

Figure 1:
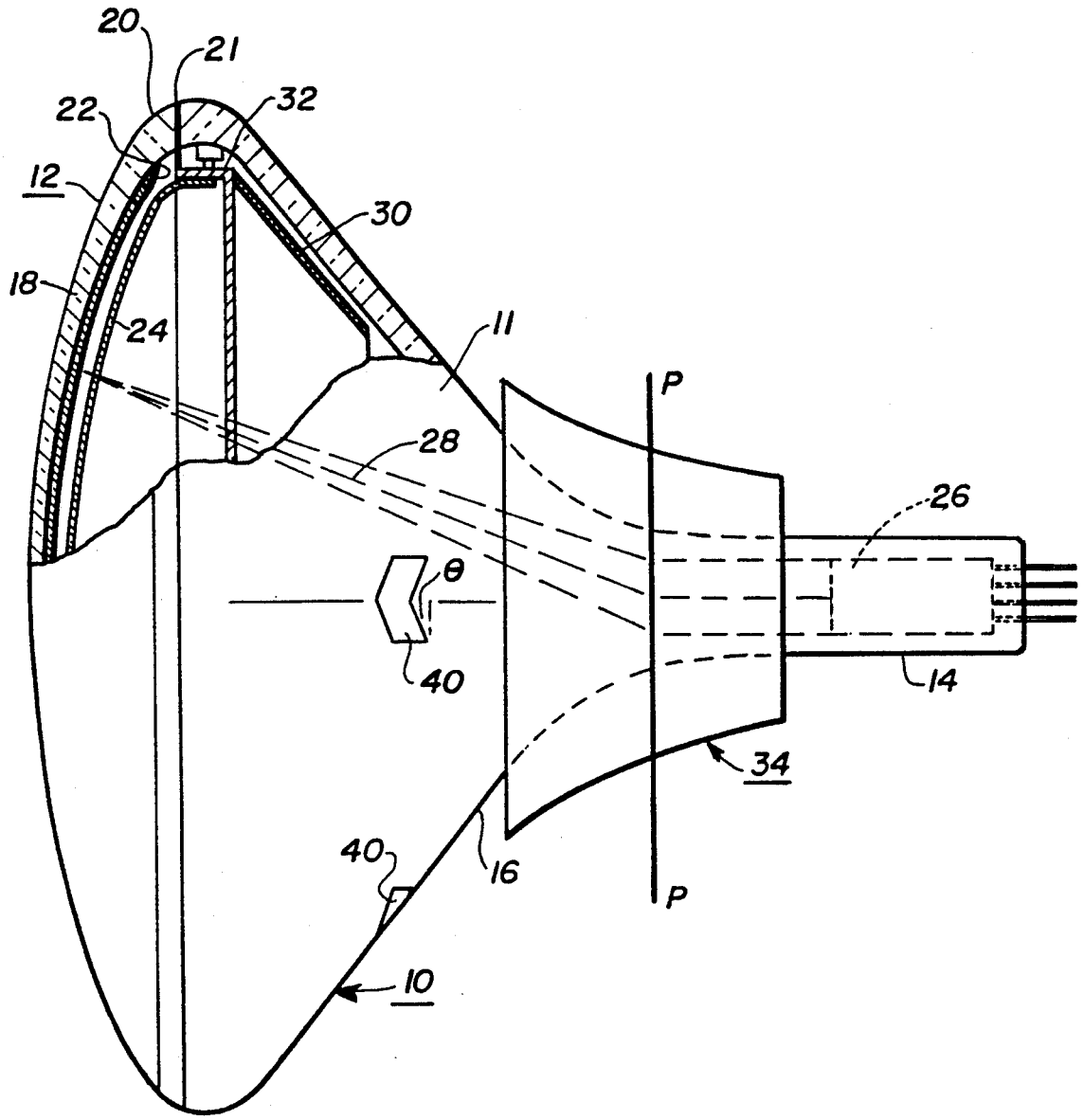
Fig. 1 PRIOR ART
FIG. 1 is a plan view, partially in section, of a prior art color cathode-ray tube (CRT)-yoke combination.

FIG. 1 shows a color cathode-ray tube 10, such as a television picture tube, having a glass envelope 11 comprising a rectangular faceplate panel 12 and a tubular neck 14 connected by a rectangular funnel 16. The panel 12 comprises a viewing faceplate 18 and a peripheral flange or sidewall 20 which is sealed to the funnel 16 with a frit seal 21. A mosaic three-color phosphor screen 22 is located on the inner surface of the faceplate 18. The screen preferably is a line screen with the phosphor lines extending substantially perpendicular to the high frequency raster line scan of the tube (normal to the plane of FIG. 1). Alternatively, the screen could be a dot screen. A multiapertured color selection electrode or shadow mask 24 is removably mounted, by conventional means, in predetermined spaced relation to the screen 22. An inline electron gun 26, shown schematically by dashed lines in FIG. 1, is centrally mounted within the neck 14 to generate and direct three electron beams 28 along coplanar convergent paths through the mask 24 to the screen 22. An internal magnetic shield 30 is attached to a frame 32 which, in turn, is attached to the mask 24.

The tube shown in FIGS. 1 and 2 is designed to be used with an external magnetic deflection yoke, such as the yoke 34 located in the neighborhood of the funnel-to-neck junction. The yoke 34 comprises a magnetically permeable core 36 on which are toroidally wound the vertical deflection coils 38. The yoke 34 also incorporates saddle-type horizontal deflection coils, not shown. When activated, the yoke 34 subjects the three beams 28 to magnetic fields which cause the beams to scan horizontally and vertically in a rectangular raster over the screen 22. The initial plane of deflection (at zero deflection) is shown by the line P—P in FIG. 1 at about the middle of the yoke 34. For simplicity, the actual curvature of the deflection beam paths in the deflection zone is not shown in FIG. 1.

The yoke 34 is designed to complement the operation of the tube 10. By that it is meant that the operation of the tube-yoke combination is considered when the components are designed by their respective manufacturers so that color purity, convergence, raster size and other performance parameters are optimized for the particular tube-yoke combination. However, television receiver and other display system manufacturers frequently purchase tube-yoke combinations from tube manufacturers who designed the tube to operate with a yoke other than that specified by the receiver or systems manufacturer. In such a situation, the performance of the tube-yoke combination may not be optimized because of non-uniformities which exist in the yoke magnetic fields. In order to "trim" or correct the yoke fields to optimize tube-yoke performance, at least one "trimmer magnet" 40 is attached to the exterior surface of the envelope 11 to provide a corrective magnetic field. As shown in FIGS. 1 and 2, the magnet 40 is attached near a corner radius and beyond the internal magnetic shield 30, toward the electron gun end of the envelope 11.

The magnet 40 comprises a body of semi-flexible plastic filled with ferrite material that is polarized end-to-end across the length (long) dimension. The magnet 40 may be rectangular or chevron-shaped. An adhesive is uniformly applied to one side of the magnet 40 for attaching the magnet to the envelope 11. Typically, the magnet 40 has a length, L, of 38.1mm, a width, W, of 12.7mm and a thickness, T, of 1.52mm. The magnet 40 is available from Magnets, Inc., Cincinnati, Oh. Where the magnet 40 has a chevron-shape, the angle $\theta$ is about 30 degrees. As described, the tube-yoke combination including the "trimmer" magnet 40 is conventional.

FIGS. 3–8 show three different embodiments of novel "trimmer" magnets with improved flexibility so that the ends of the magnets are not prone to lift-off the envelope during cold temperature storage or transportation of the tube-yoke assembly.

A first embodiment of a novel "trimmer" magnet 140 is shown in FIGS. 3 and 4. The magnet 140 is similar to the prior magnet 40 in composition, length and width dimensions, and differs only in structure and thickness. The novel magnet 140 includes a first and a second outer portion 142 and 144, respectively, of thickness, T, separated by a central portion 146 of reduced thickness, T', which forms a constriction across the width of the magnet 140 and is about one-half the thickness of the remainder of the magnet, or about 0.76mm. The constriction of the central portion 146 may be formed by molding or trimming one or both of the major surfaces 150 and 152. Additional flexibility can be achieved by providing a slit 148 across the width of the magnet 140, within the constriction. The slit 148 has a depth less than the thickness, T' of the the central portion. The configuration of slit 148 is exaggerated in FIGS. 3 and 4 and may, in fact, be straight-sided rather than V-shaped. The magnet 140 is polarized end-to-end across the length, L. No other poles are present in the magnet 140.

Figures 5, 6, 7, 8:
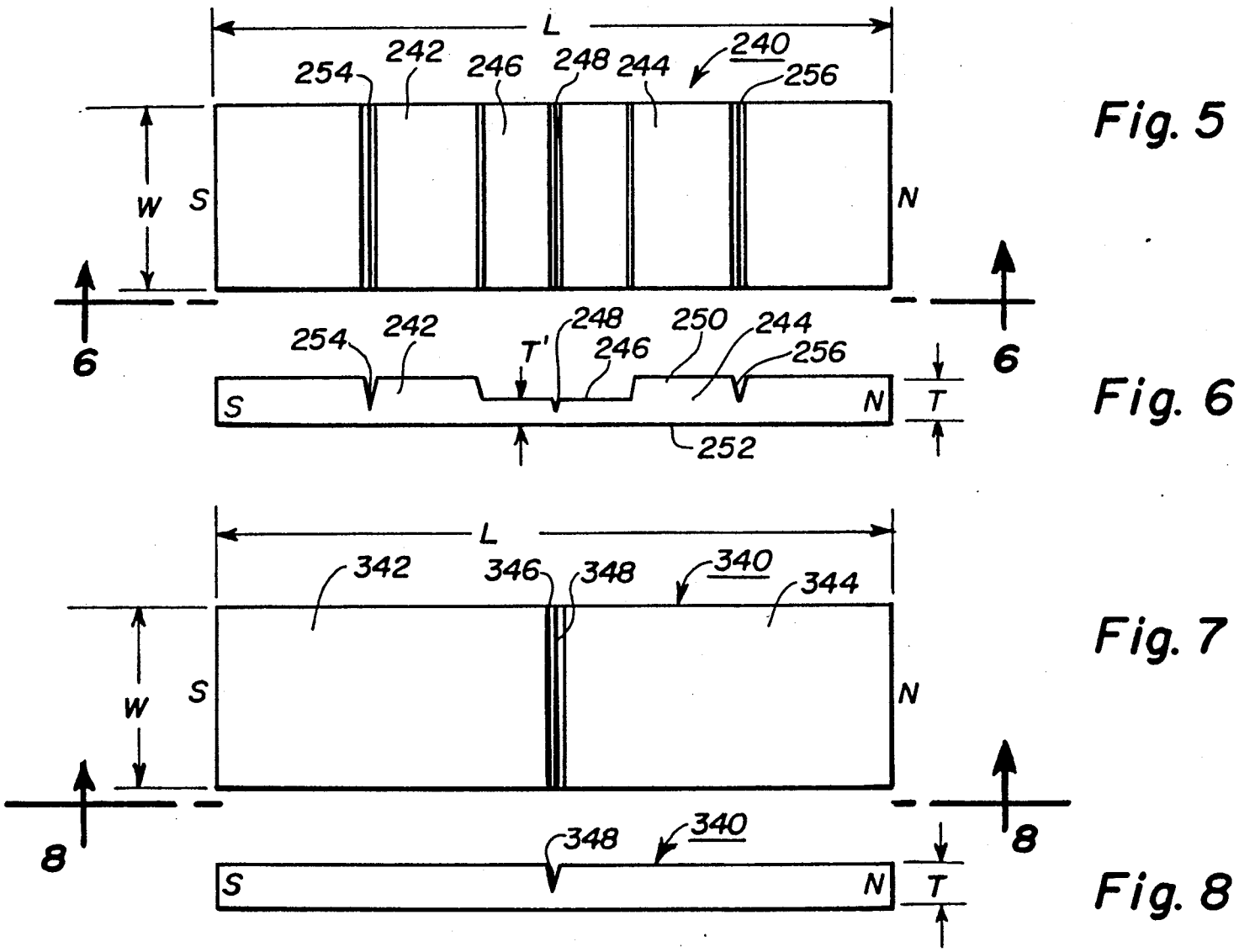
FIGS. 5 and 6 show a plan view and a side view, respectively, of a second embodiment of the present invention.
FIGS. 7 and 8 show a plan view and a side view, respectively, of a third embodiment of the present invention.

A second embodiment of the novel "trimmer" magnet is shown in FIGS. 5 and 6. Rectangularly-shaped magnet 240 includes a first and a second outer portion 242 and 244, respectively, having a thickness, T, separated by a central portion 246 of reduced thickness, T', which forms a constriction across the width of the magnet 240 and is about one-half the thickness of the remainder of the magnet. The constriction is shown as being formed inwardly from the first major surface 250 although it should be apparent that it may be formed in either or both of the major surfaces 250 and 252. Additional flexibility can be achieved by providing a first slit 248 across the width of the magnet 240, within the constriction. Still greater flexibility can be obtained by provided second and third slits 254 and 256 across the width of the two outer portions 242 and 244. Each of the slits, 248, within the central portion 246, and 254 and 256, within the outer portions 242 and 244, respectively, are formed partially through the respective portions and may be straight-sided or V-shaped, as previously described. The magnet 240 is polarized end-to-end across the length, L, and no other poles are present.

Yet another embodiment of the novel "trimmer" magnet is shown in FIGS. 7 and 8. The magnet 340 is rectangularly-shaped and has a substantially uniform thickness, T. At least one slit 348 is formed across and partially through the width of the magnet 340. Typically the depth of the slit 348 is about one-half the thickness of the magnet. As shown, the slit 348 forms the central portion 346 and defines the two outer portions 342 and 344. The slit 348 may be straight-sided or V-shaped, as previously described. While not shown in FIGS. 7 and 8, additional slits may be formed in the outer portions 342 and 344 to increase the flexibility of the magnet 340. The magnet 340 is polarized end-to-end across the length, L, and no other poles are present.

What is claimed is:

1. In combination, a color cathode-ray tube having a glass envelope, means for producing magnetic fields positioned on said envelope and at least one semi-flexible corrective magnetic field means attached to a curved portion of said envelope, said corrective magnetic field means having a given thickness, the improvement wherein said corrective magnetic field means comprises at least one portion of reduced thickness formed therein to provide an increase in flexibility of said corrective magnetic field means to provide conformity to said curved portion of said envelope.

2. The combination defined in claim 1 wherein said portion of reduced thickness comprises a constriction formed across said corrective magnetic field means.

3. The combination defined in claim 2 wherein said constriction has a thickness of about one-half the thickness of the remainder of said corrective magnetic field means.

4. The combination defined in claim 1 wherein said portion of reduced thickness comprises a slit formed across said corrective magnetic field means, said slit having a depth less than the thickness of the remainder of said corrective magnetic field means.

5. In combination, a color cathode-ray tube having a glass envelope, a deflection yoke positioned on said envelope for producing magnetic fields and at least one semi-flexible body of magnetic material of substantially uniform thickness attached by a suitable adhesive to a curved portion of said envelope to provide a corrective magnetic field, the improvement wherein said body of magnetic material comprises two outer portions separated by a central portion of reduced thickness which provides an increase in flexibility of said body to provide conformity to said curved portion of said envelope.

6. The combination defined in claim 5 wherein said central portion of reduced thickness comprises a constriction formed across the width of said body.

7. The combination defined in claim 6 wherein said constriction is formed in one major surface.

8. The combination defined in claim 7 wherein said constriction is formed in two opposed major surfaces.

9. The combination defined in claim 6 wherein said constriction has a thickness of about one-half the thickness of the remainder of said body.

10. The combination defined in claim 6 wherein a slit is provided across said body within said constriction, said slit having a depth less than the thickness of said central portion.

11. The combination defined in claim 10 wherein at least one slit is formed across and partially through the width of at least one of said outer portions.

12. The combination defined in claim 5 wherein said central portion of reduced thickness comprises a slit extending across the width of said body, said slit having a depth less than the thickness of the remainder of said body.

13. The combination defined in claim 12 further including at least one slit formed across and partially through the width of at least one of said outer portions.

* * * * *

UNITED STATES PATENT AND TRADEMARK OFFICE
CERTIFICATE OF CORRECTION

PATENT NO. : 5,023,509

DATED : June 11, 1991

INVENTOR(S) : Samuel Broughton Deal et al.

It is certified that error appears in the above-identified patent and that said Letters Patent is hereby corrected as shown below:

Col. 2 line 10, after "side"
add --view,--.

Signed and Sealed this

Twenty-seventh Day of October, 1992

*Attest:*

DOUGLAS B. COMER

*Attesting Officer*

*Acting Commissioner of Patents and Trademarks*